US007012590B2

(12) United States Patent
Chen

(10) Patent No.: US 7,012,590 B2
(45) Date of Patent: Mar. 14, 2006

(54) MOTIONLESS-IMAGE DISPLAY WITH AUTO-ADJUSTING LIGHT SYSTEM AND THE METHOD FOR FORMING THE SAME

(75) Inventor: Huang-Tsun Chen, Taipei (TW)

(73) Assignee: Aiptek International Inc., Hsin-Chu (TW)

( * ) Notice: Subject to any disclaimer, the term of this patent is extended or adjusted under 35 U.S.C. 154(b) by 345 days.

(21) Appl. No.: 09/990,353

(22) Filed: Nov. 23, 2001

(65) Prior Publication Data

US 2003/0098831 A1 May 29, 2003

(51) Int. Cl.
*G09G 3/36* (2006.01)

(52) U.S. Cl. ..... 345/87; 345/95; 345/97

(58) Field of Classification Search ..... 345/87, 345/8, 107, 211, 95, 97; 348/220.1, 302, 348/745; 315/307; 358/113, 335; 354/441; 359/55; 340/781; 349/42
See application file for complete search history.

(56) References Cited

U.S. PATENT DOCUMENTS 4,420,773 A * 12/1983 Toyoda et al. ..... 386/118
4,527,093 A * 7/1985 Yamauchi et al. ..... 315/307
4,608,599 A * 8/1986 Kaneko et al. ..... 348/164
4,742,369 A * 5/1988 Ishii et al. ..... 396/213
5,093,654 A * 3/1992 Swift et al. ..... 345/76
5,157,525 A * 10/1992 Eaton et al. ..... 345/87
5,386,253 A * 1/1995 Fielding ..... 348/745
5,432,526 A * 7/1995 Hyatt ..... 345/87
5,781,233 A * 7/1998 Liang et al. ..... 348/302
5,828,367 A * 10/1998 Kuga ..... 345/211
5,831,693 A * 11/1998 McCartney et al. ..... 349/42
5,844,530 A * 12/1998 Tosaki ..... 345/8
6,531,997 B1 * 3/2003 Gates et al. ..... 345/107
6,556,242 B1 * 4/2003 Dunton et al. ..... 348/220.1

FOREIGN PATENT DOCUMENTS

JP 2000-340621 * 8/2000 ..... 345/87

* cited by examiner

*Primary Examiner*—Bipin Shalwala
*Assistant Examiner*—Prabodh Dharia
(74) *Attorney, Agent, or Firm*—Rosenberg, Klein & Lee

(57) ABSTRACT

An auto-adjusting light system includes an inputting sub-circuit, a photosensitive sub-circuit, a controlling sub-circuit, a starting sub-circuit, and a display. The inputting sub-circuit is used to input a setting value. The photosensitive sub-circuit is used to catch variations of the light source in the background. The controlling sub-circuit is coupled with the inputting sub-circuit and the photosensitive sub-circuit to receive the setting value and the variation value and generates a controlling signal. The starting sub-circuit is coupled with the controlling sub-circuit to receive the controlling signal and generates a starting voltage. The display is coupled with the starting sub-circuit to receive the starting voltage lightening the display.

6 Claims, 3 Drawing Sheets

MOTIONLESS-IMAGE DISPLAY WITH AUTO-ADJUSTING LIGHT SYSTEM AND THE METHOD FOR FORMING THE SAME

BACKGROUND OF THE INVENTION

1. Field of the Invention

The present invention relates generally to an image processing system, and more particularly to a motionless-image display with auto-adjusting light system and the method for forming the same.

2. Description of the Prior Art

Recently, there are various digital products that have been developed within the industry, such as notebooks, Personal Digital Assistants (PDA), and Consumption-Communication-Computers (3C) Usually, these digital products include or connect with a monitor to display an image, such as liquid crystal display (LCD) or liquid crystal panel. For the image processing apparatus, in addition, they can be classed as a motionless-image processing apparatus, such as digital camera, digital album, and a moving-image processing apparatus, such as digital video camera.

FIG. 1 shows a conventional motionless-image apparatus 100, such as digital photo-album. The motionless-image apparatus 100 comprises: a display unit 105, a back-lighted mode 110, an inverter circuit 115, a central processing unit (CPU) 120, a read only memory (ROM) 125, a dynamic memory 130, a serial interface 135, a storage medium 140, a power 145 and a plurality of keypads 150. The central processing unit 120 catches an image file from the storage medium 140 to decompress the image file, at the same time the image file format of the image file is transformed into a digital format that is necessary for the display unit 105, and then the image is shown on the display unit 105.

Nevertheless, conventional motionless-image apparatus 100 usually uses a liquid crystal device as the display unit 105. In general, the Light source of the liquid crystal device is supplied from the lamp and the light-guiding plant of the back-lighted mode 110 that is located under the liquid crystal device, and the shading value can be changed by controlling the liquid crystal, so the contrast and the brightness can be changed by controlling the lamp. Generally, there are functions for adjusting the contrast and the brightness in the liquid crystal display, but the user only uses the manual method to adjust rheostat until an acceptable contrast and brightness is achieved. If the light source in the background is invariable state or steady state, the user adjusts the liquid crystal display until a fixed contrast and brightness is achieved. If the motionless-image apparatus is movable state, the light source in the background will be variable state or unsteady state, so that the user has to always adjust the contrast and brightness of the liquid crystal display.

In accordance with the above description, a new motionless-image display with auto-adjusting light system is therefore necessary, so as to strengthen and increase the functions of the motionless-image processing display.

SUMMARY OF THE INVENTION

In accordance with the present invention, a new motionless-image processing display with an auto-adjusting light system is provided that substantially overcomes the drawbacks of the above mentioned problems in the conventional system. Additionally in order to strengthen the functions of the motionless-image processing system, so as to increase and improve efficiency of conventional image processing apparatus.

Accordingly, it is an object of the present invention to provide a new motionless-image display with auto-adjusting light system. The present invention combines an auto-adjusting light system, so as to adjust the contrast and the brightness according to variations of a light source in the background, whereby the present invention can add and strengthen the motionless-image processing functions. Therefore, this invention corresponds to economic effect and utilization in industry.

Another object of the present invention is to provide an auto-adjusting light system of the motionless-image display. This invention can apply a photosensitive sub-circuit to detect variations in the background of the light source. Further the sub-circuit can independently control the contrast and brightness of the motionless-image display and the feed-back mechanism. Whereby the motionless-image display can synchronously adjust the contrast and the brightness as the various light of the background by itself, to give the user an advantage and appreciate a better quality of picture.

In accordance with the present invention, a new motionless-image display with an auto-adjusting light system, such as liquid crystal display or digital photo-album, is provided. In this invention, the auto-adjusting light system comprises: a first inputting sub-circuit for inputting a setting value, wherein the setting value is an internal value that has been predetermined in the sub-circuit, or it is an external value that is set manually. A second inputting sub-circuit for catching variations of the light source in the background, wherein the second inputting sub-circuit is coupled with the first inputting sub-circuit to form an output node. A controlling sub-circuit that is coupled with the output node to receive the setting value and the variation value while starting a sub-circuit that is coupled with the controlling sub-circuit to receive a controlling signal. In turn this will generate a starting voltage; a display that is coupled with the starting sub-circuit to receive the starting voltage, so as to lighten the display.

In the present invention, when the second sub-circuit acquires the variation of the light source in the background, the second sub-circuit transmits the variation value to the output node. Then the controlling sub-circuit receives the variation value and the setting value from the output node, so as to compare the variation value with the setting value to generate the controlling signal. Afterward, the controlling signal is transmitted into the starting sub-circuit from the controlling sub-circuit to control the contrast and the brightness of the motionless-image display. Furthermore, the controlling sub-circuit can continuously feed the variation value back the input terminal of the controlling sub-circuit, so as to compare the difference between the variation values, whereby the present invention achieves a purpose that can synchronously adjust the contrast and the brightness of the motionless-image display.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DESCRIPTION OF THE PREFERRED EMBODIMENT

Preferred embodiments of the present invention will now be described in greater detail. Nevertheless, it should be recognized that the present invention can be practiced in a wide range of other embodiments besides those explicitly described, and the scope of the present invention is expressly not limited except as specified in the accompanying claims.

Figure 1:
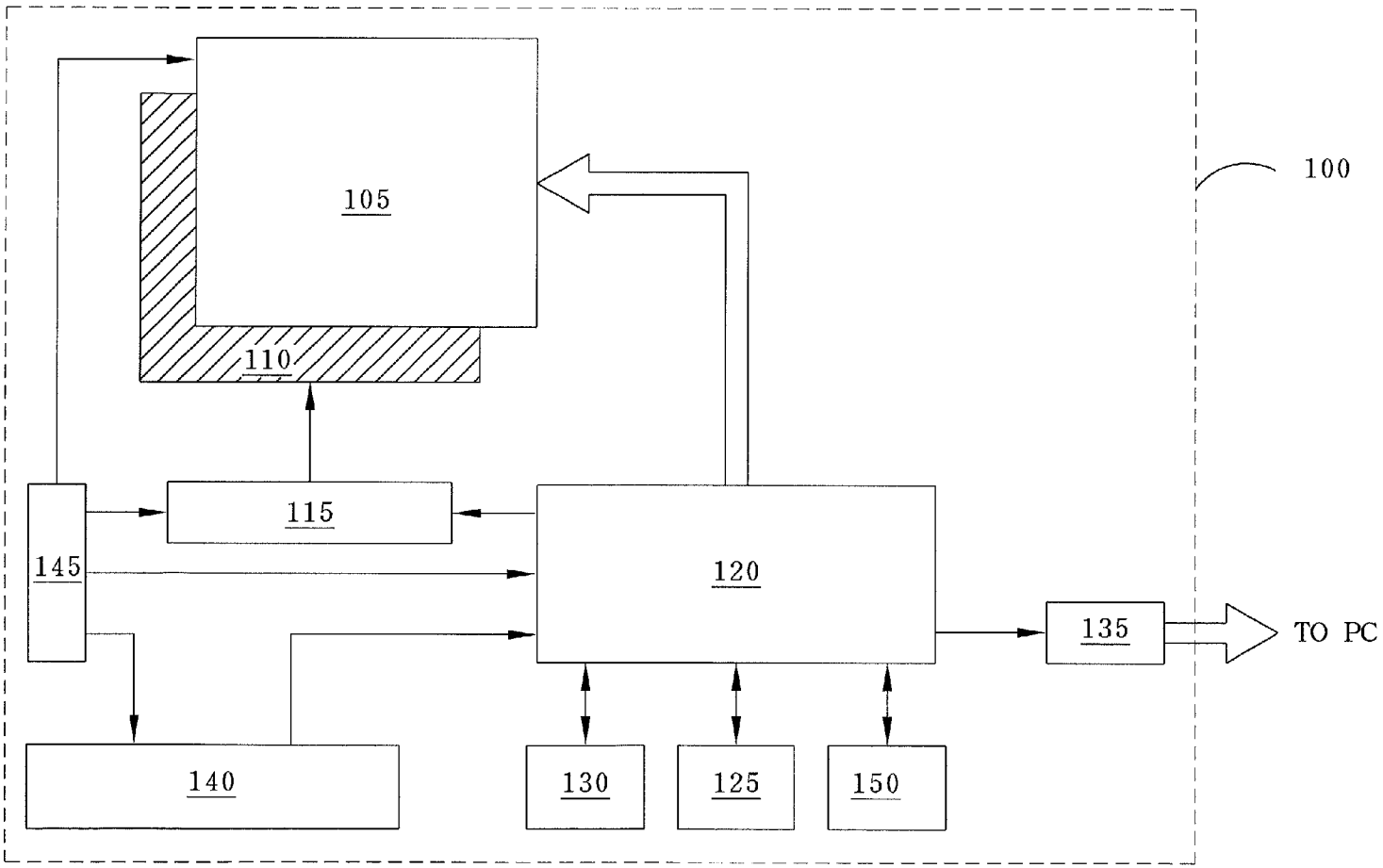
FIG.1(Prior Art)
FIG. 1 shows block diagram of the conventional motionless-image processing display.
Figure 2:
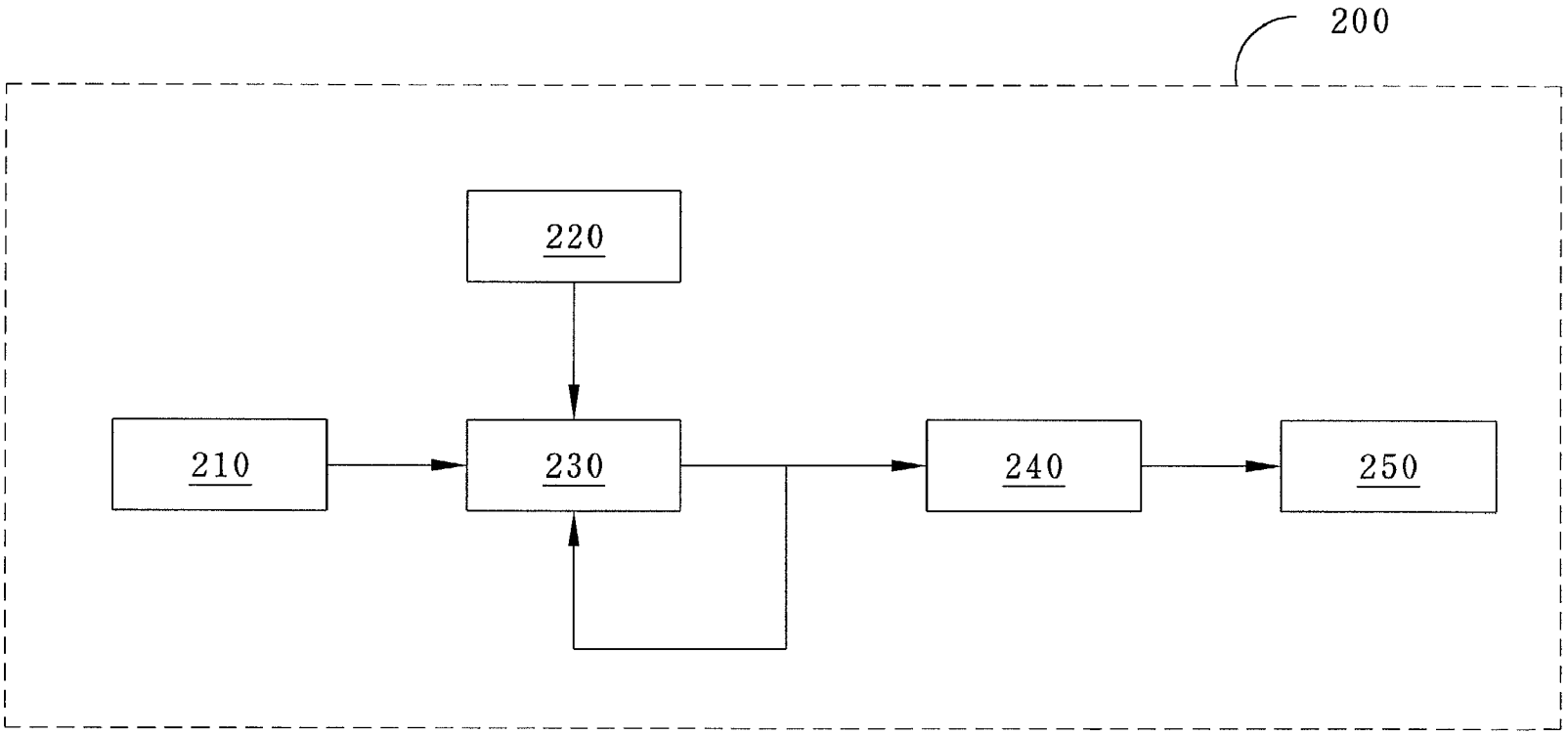
FIG. 2 shows flow chart of the auto-adjusting light system of the motionless-image image processing system in accordance with the first embodiment of the present invention.

As illustrated in FIG. 2, in the first embodiment of the present invention, first of all, an auto-adjusting light system 200 of a motionless-image display is provided. The auto-adjusting light system 200 comprises: an inputting means 210 for setting a predetermined value; a photosensitive means 220 for acquiring a variation value of the light source in the background; a controlling means for receiving the predetermined value and the variation value to perform a comparing action and generate a controlling signal, wherein the controlling means 230 can feed back the variation value to compare the difference between the variation values until the variation values that are the same values; a starting means 240 for receiving the controlling signal to generate a starting voltage; a displaying means 250 for receiving the starting voltage to adjust the contrast and the brightness of the displaying means 250.

Referring to FIG. 2, in this embodiment, the auto-adjusting light system 200 can set a predetermined value by the inputting means 210, wherein the predetermined value is an internal value that has been predetermined in the auto-adjusting light system 200, or the predetermined value is set via an inputting button manually. When the motionless-image display is placed in the surrounding where the light source in the background is invariable state or steady state, first of all, in the auto-adjusting light system 200, the inputting means 210 transmits the predetermined value into the controlling means 230, and further, the photosensitive means 220 can acquire a first variation value of the light source in the background by transduction of optical radiation to output it into the controlling means 230. Then the controlling means 230 generates a first controlling signal according to the first variation value and the predetermined value. Afterward, the controlling means 230 feeds the first variation value back unassisted and transmits the first controlling signal into the starting means 240. Subsequently, the starting means 240 generates a first starting voltage according to the first controlling signal, and then the first starting voltage is transmitted into displaying means 250 to lighten the light with a first contrast and a first brightness.

On the other hand, when the motionless-image apparatus is placed in the surrounding where the light source in the background is a variable state or unsteady state. The photosensitive means 220 of the auto-adjusting light system 200 can acquire a second variation value of the light source in the background to output it into the controlling means 230. When the controlling means 230 receives the second variation value and feeds back the first variation value, the controlling means 230 compares the difference between the second variation value and the first variation value to generate a second controlling signal. Afterward, the controlling means 230 transmits the second controlling signal into the starting means 240 to generate a second starting voltage according to the second controlling signal. Subsequently, the second starting voltage is transmitted into displaying means 250 to lighten the light with a second contrast and a second brightness. If the light source in the background is continuously changed, the photosensitive means 220 of the auto-adjusting light system 200 will perform the above feed back/controlling mechanism again and again until the second variation value is equal to the first variation value, that is, the light source in the background is invariable state or steady state.

Figure 3:
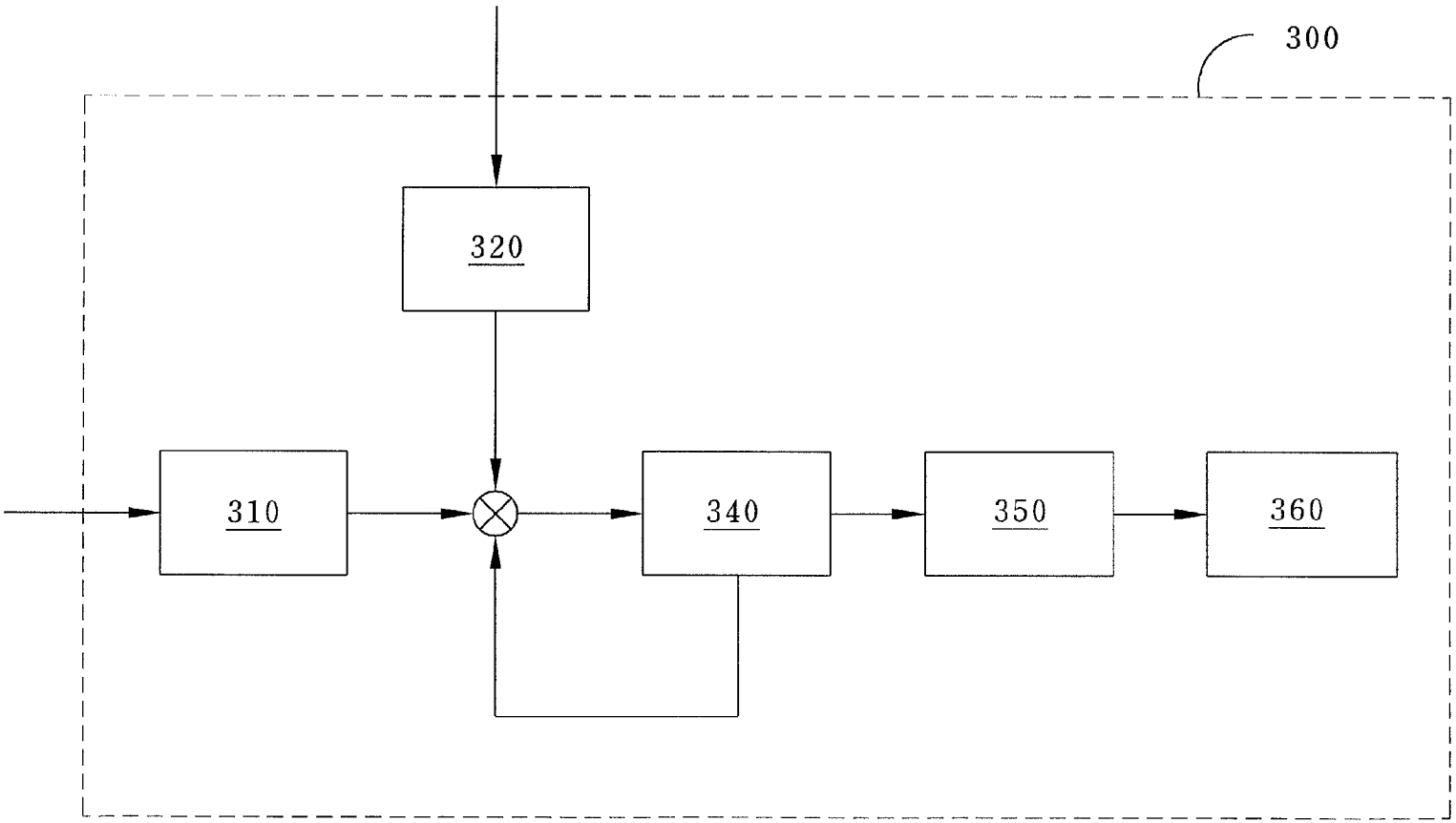
FIG. 3 shows block diagram of the auto-adjusting light system of the motionless-image display in accordance with the second embodiment of the present invention.

As illustrated in FIG. 3, in the second embodiment of the present invention, first of all, a digital photo-album with an auto-adjusting light system 300 is provided. The auto-adjusting light system 300 comprises an inputting sub-circuit 310 coupled to receive a setting value. Wherein the setting value is an internal value that has been predetermined in the auto-adjusting light system 300, or it can be also predetermined via an inputting button manually. A photosensitive sub-circuit 320 with the output terminal coupled with the output terminal of the inputting sub-circuit 310 to form an output node 330. Further, the photosensitive sub-circuit 320 comprises a photo-sensor, such as photosensitive resistor; a controlling sub-circuit 340 with an input terminal coupled with the output node 330 to receive a plurality of variation values and the setting value. Further, the output terminal of the controlling sub-circuit 340 is coupled with the output node 330 to feed back the plurality of variation values in order. Wherein the controlling sub-circuit 340 comprises a comparator to perform compared action, and that the controlling sub-circuit 340 can generate a plurality of controlling signals according to the difference between the variation value and the setting value and the difference between the plurality of variation values from each other. An inverter 350 with an input terminal coupled with the controlling sub-circuit 340 to receive the plurality of controlling signals, wherein the inverter 350 can generate a plurality of starting voltages according to the plurality of controlling signals. A displaying sub-circuit 360 with an input terminal coupled with the output terminal of the inverter 350 to receive the plurality of starting voltages, so as to lighten the light with various contrasts and brightness, wherein the displaying sub-circuit 360 comprises a liquid crystal display.

In these embodiments of the present invention, the present invention combines an auto-adjusting light system with the a motionless-image display to auto-adjust the contrast and the brightness according to variation of light source in the background, whereby the present invention can add and strengthen the motionless-image processing functions. Therefore, this invention corresponds to economic effect and utilization within the industry. Furthermore, this invention can apply a photosensitive sub-circuit to detect variations in the light source in the background, and further, the contrast and the brightness of the motionless-image display can be controlled by itself with a sub-circuit for controlling feed-back mechanism. Whereby the motionless-image display can synchronously adjust the contrast and the brightness as the various light of the background, so as to advantage user to appreciate the better quality of picture.

Of course, it is possible to apply the present invention for the motionless-image display, and to any motionless-image display with image processing system. Also, the present invention that combines the auto-adjusting light system with photo-sensor and feed-back controlling mechanism concerning auto-adjusting the contrast and the brightness for suiting to the variation of the light source in the background has not been developed at present.

Although specific embodiments have been illustrated and described, it will be obvious to those skilled in the art that various modifications may be made without departing from what is intended to be limited solely by the appended claims.

Obviously, many modifications and variations of the present invention are possible in light of the above teachings. It is therefore to be understood that within the scope of the appended claims, the present invention may be practiced otherwise than as specifically described herein.

What is claimed is:

1. An auto-adjusting light apparatus of a digital photo-album comprising:

an inputting sub-circuit that is coupled to receive a setting value;

a photosensitive sub-circuit that is coupled with the output terminal of said inputting sub-circuit to form a node, wherein said photosensitive sub-circuit can generate a plurality of variation values according to the various light source in the background;

a controlling sub-circuit whose the input terminal is coupled with said node to receive said plurality of variation values and said setting value, wherein the output terminal of said controlling sub-circuit is coupled with said output node to feed back said plurality of variation values in order, and said controlling sub-circuit can perform a compared action to generate a plurality of controlling signals according to the difference between said plurality of variation values and said setting value and the difference between said plurality of variation values from each other;

an inverter whose the input terminal is coupled with the controlling sub-circuit to receive the plurality of controlling signals, wherein the inverter can generate a plurality of starting voltages according to the plurality of controlling signals; and a liquid crystal displaying sub-circuit whose the input terminal is coupled with the output terminal of said inverter to receive said plurality of starting voltages, so as to lighten the light with various contrasts and brightness.

2. The method for auto-adjusting light of the digital photo-album according to claim 1, wherein said setting value is an internal value of said digital photo-album.

3. The method for auto-adjusting light of the digital photo-album according to claim 1, wherein said setting value is inputted via an inputting button by manual.

4. The method for auto-adjusting light of the digital photo-album according to claim 1, wherein said photosensitive sub-circuit comprises a photo-sensor.

5. The method for auto-adjusting light of the digital photo-album according to claim 4, wherein said photo-sensor comprises a photosensitive resistor.

6. The method for auto-adjusting light of the digital photo-album according to claim 1, wherein said controlling sub-circuit comprises a comparator.

* * * * *